United States Patent [19]

Alpert

[11] 4,033,659

[45] July 5, 1977

[54] UNDERWATER CONNECTOR

[75] Inventor: Louis Alpert, Ridgecrest, Calif.

[73] Assignee: The United States of America as represented by the Secretary of the Navy, Washington, D.C.

[22] Filed: July 26, 1976

[21] Appl. No.: 708,505

[52] U.S. Cl. ..... 339/60 R; 339/61 R

[51] Int. Cl.[2] ..... H01R 13/52

[58] Field of Search ..... 339/60, 61, 59, 94, 339/102

[56] References Cited

UNITED STATES PATENTS

| | | | |
|---|---|---|---|
| 2,753,534 | 7/1956 | Sprigg | 339/60 R |
| 2,881,406 | 4/1959 | Arson | 339/94 M |
| 3,613,048 | 10/1971 | Brundza | 339/94 A |
| 3,643,208 | 2/1972 | Massa, Jr. | 339/94 R |
| 3,742,427 | 6/1973 | Ballard | 339/60 M |

FOREIGN PATENTS OR APPLICATIONS

| | | | |
|---|---|---|---|
| 2,000,483 | 7/1971 | Germany | 339/94 M |

*Primary Examiner*—Roy Lake
*Assistant Examiner*—Neil Abrams
*Attorney, Agent, or Firm*—R. S. Sciascia; Roy Miller

[57] ABSTRACT

An underwater connector having a deformable plug to provide for tolerance buildup and for positive electrical contact when connected to an underwater device.

6 Claims, 2 Drawing Figures

UNDERWATER CONNECTOR

BACKGROUND OF THE INVENTION

The present invention relates to electrical connectors, and more particularly to an electrical connector for underwater use.

An electrical connector, small in size and simple in design, inexpensive, and reliable when submerged under water, is desired as a connector for underwater devices.

SUMMARY OF THE INVENTION

The present invention provides an electrical connector having contacts which make positive electrical contact with a receiving cavity in a printed circuit board and maintains its electrical integrity when submerged under water. The electrical contacts are imbedded in a polyurethane plug having a circumferential slot adjacent to the connector housing such that when the plug is secured in the receiving cavity it will deform sufficiently to maintain good electrical contact regardless of the tolerance errors. The watertight seal is provided by an O-ring situated between the receiving device and the electrical connector.

DESCRIPTION OF THE PREFERRED EMBODIMENT

Figure 1:
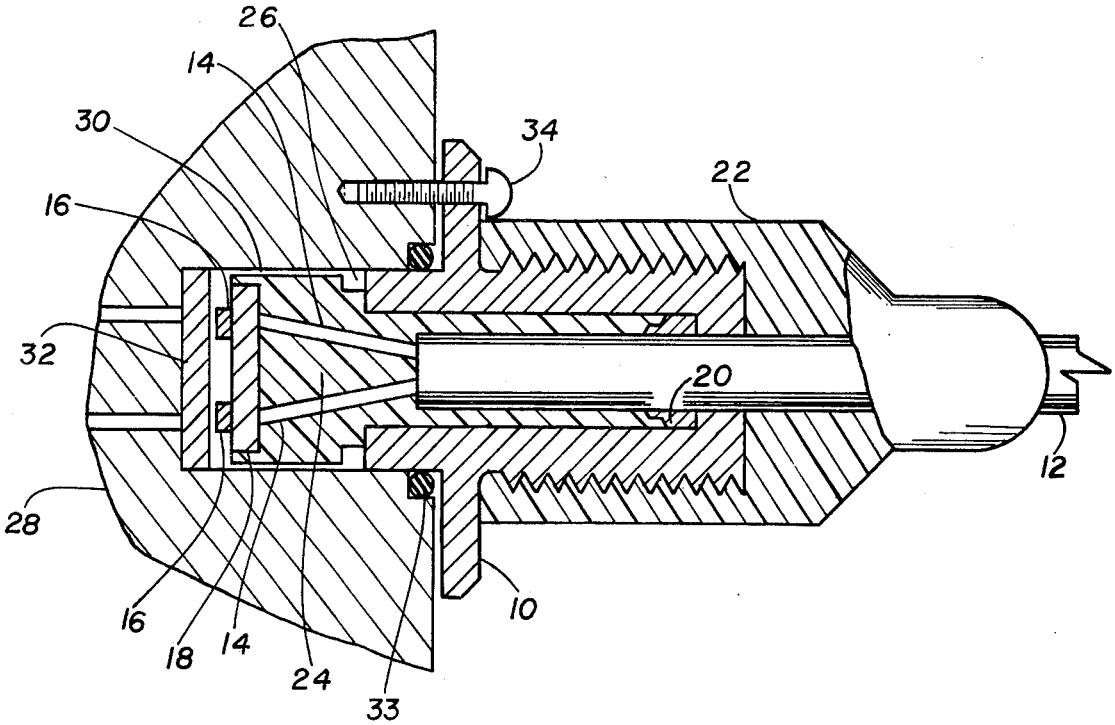
FIG. 1 is a cross-sectional veiw of the present invention.

Referring now to FIG. 1, a housing 10 is made from a non-corrosive metal, such as brass, and is formed in the shape of a hollow cylinder with a circumferential flange near one end and the opposite end closed except for a bore hole. The external surface of the housing 10 between the flange and the closed end is externally threaded. A cable 12, having a plurality of wires 14 and an insulating jacket such as neoprene, has one end passed through the bore hole to the interior of the housing 10. The individual wires 14 are connected to individual electrical contacts, 16 which are mounted on a plug board 18 made of a fairly rigid material such as glass fiber based epoxy resin.

A sleeve 20 surrounds the cable 12 interior to the housing 10, acting as a strain relief to prevent the cable from pulling free. A cap 22 of a resilient material such as polyurethane is molded around the threaded portion and closed end of the housing 10 and around part of the cable 12 exiting from the housing.

A plug 24 of deformable insulating material such as polyurethane fills the interior of the housing 10 and extends a distance beyond the open end of the housing with the plug board 18 imbedded therein flush with the surface of the end of the plug. The outside dimensions of the plug 24 are the same as those of the body of the housing 10. A circumferential slot 26 surrounds the plug 24 immediately adjacent to the open end of the housing 10.

An underwater device 28 has a receptacle 30 with a printed circuit (PC) board 32 imbedded therein, the receptacle having a groove around its lip in which an O-ring 33 is seated.

Electrical connection is made by inserting the plug 24, including the open end of the housing 10, into the receptacle 30 and securing the connector to the underwater device 28 by any suitable means, such as screws 34 inserted through holes in the flange. The length of the plug 24 is such that, regardless of the variations in PC board 32 thickness and in connector cavity 30 depth, when secured, there will be sufficient pressure against the printed circuit board 32 to maintain good electrical contact between the printed circuit board and the connector electrical contacts 14. The O-ring 33, when packed in grease, provides a waterproof seal so that when immersed in water the electrical contact area is kept dry to prevent short circuiting.

Thus, despite the tolerance buildup between the maximum material conditions (thin PC board 32 and deep receptacle 30 vs. thick PC board and shallow receptacle) and the variations in the length of the plug 24, a good pressure contact is maintained.

Figure 2:
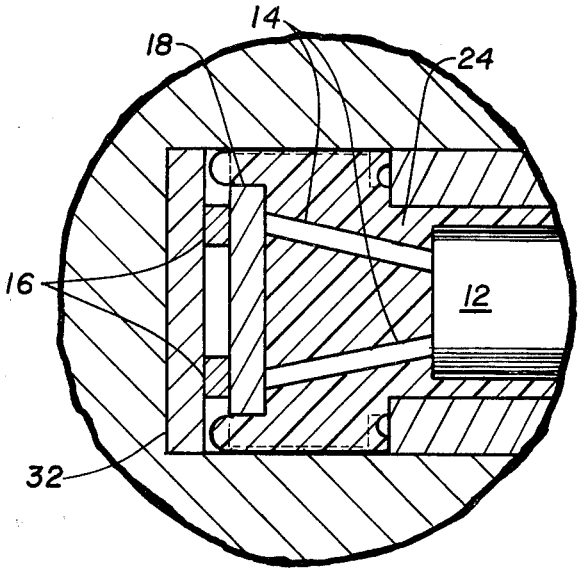
FIG. 2 is an enlarged cross-sectional view of the plug end of the present invention when secured in a receiving device.

FIG. 2 illustrates how the plug 24, due to the circumferential slot 26, may deform as it is compressed. The amount of deformation depends upon the tolerance buildup. The dotted lines indicate the undeformed configuration of the plug 24 while the solid line represents the results of the compression when the connector is secured to the underwater device 28.

The configuration of the connector described herein is cylindrical, but any shape can be used depending on the shape of the receptacle 30. The relative insensitivity to tolerance buildup of the present connector results in a simple structure which is easy to manufacture, since it does not require the close manufacturing tolerances of prior art underwater connectors due to the adaptability of the plug length to its receptacle length.

What is claimed is:

1. An underwater connector for an electrical cable having at least one conductor comprising;

a hollow housing having an open end and a closed end;

said closed end having a bore hole therethrough;

a flange extending around the outer circumference of said hollow body near the open end thereof;

said flange acting to limit the penatration of said hollow body into said receptacle and also act as a retaining device to maintain said hollow body in place within the receptacle;

said cable entering said housing through said bore hole and substantially extending the length of said housing;

said at least one conductor extending through and beyond the open end of said housing;

means in physical engagement with said cable and abutting the inner surface of said closed end of said housing for securing the cable in said housing;

a plug of deformable insulating material filling the interior of said hollow housing and extending a distance beyond the open end of said housing;

the exterior dimensions of the plug extending beyond said open end of the housing being substantially equal to the interior dimensions of said receptacle;

a circumferential slot extending around said portion of said plug extending beyond the open end of the housing and immediately adjacent the housing at the open end thereof;

said plug surrounding the one end of said cable providing insulation between and around said at least one conductor and said housing and said receptacle;

the length of said plug being such that when said plug is secured in said receptacle said plug is always compressed;

contact means at the end of said receptacle adapted to be contacted by said at least one conductor;

a plug board inset flush with the end of said plug which is external to said hollow housing;

means associated with said flange for connecting said underwater connector in said receptacle;

said compression of said plug acting to insure that there will be sufficient pressure between the plug board and receptacle contact means to maintain a positive electrical contact there between.

2. An underwater connector as recited in claim 1 further comprising;

a cap of a resilient material covering the external of said hollow housing from said flange to said closed end and including part of said cable exterior to said hollow housing.

3. An underwater connector as recited in claim 2 wherein;

the material of said hollow housing comprises a noncorrosive metal.

4. An underwater connector as recited in claim 3 wherein;

said noncorrosive metal comprises brass.

5. An underwater connector as recited in claim 2 wherein;

said resilient material comprises polyurethane.

6. An underwater connector as recited in claim 1 wherein;

said deformable insulating material comprises polyurethane.

* * * * *